US005361993A

United States Patent [19]

Andersson

[11] Patent Number: 5,361,993

[45] Date of Patent: Nov. 8, 1994

[54] DEVICE FOR MATERIAL REMOVING PROCESSING OF A MATERIAL LAYER

[75] Inventor: Carl-Gustaf Andersson, Slättgränd, Sweden

[73] Assignee: Aquajet Systems AB, Gällö, Sweden

[21] Appl. No.: 162,786

[22] PCT Filed: Aug. 21, 1991

[86] PCT No.: PCT/SE91/00549

§ 371 Date: Mar. 22, 1993

§ 102(e) Date: Mar. 22, 1993

[87] PCT Pub. No.: WO92/03269

PCT Pub. Date: Mar. 5, 1992

Related U.S. Application Data

[63] Continuation of Ser. No. 30,017, Mar. 22, 1993, abandoned.

[30] Foreign Application Priority Data

Aug. 24, 1990 [SE] Sweden ..... 9002724

[51] Int. Cl.[5] ..... B28D 1/22; E01C 23/12; E21C 25/60; B05B 3/14

[52] U.S. Cl. ..... 239/752; 239/754; 239/227; 404/90

[58] Field of Search ..... 239/750, 752, 754, 227, 239/264, 102.1; 404/90; 299/17; 175/424

[56] References Cited

U.S. PATENT DOCUMENTS

| | | | |
|---|---|---|---|
| 3,027,095 | 3/1962 | Paasche | 239/227 X |
| 3,985,161 | 10/1976 | Nelson | 239/752 X |
| 4,036,437 | 7/1977 | Dreher . | |
| 4,081,200 | 3/1978 | Cheung . | |
| 4,619,551 | 10/1986 | Juan et al. . | |
| 4,637,656 | 1/1987 | Medeot . | |
| 4,753,549 | 6/1988 | Shook et al. | 239/227 X |
| 4,793,734 | 12/1988 | Shook et al. | 239/227 X |
| 4,854,770 | 8/1989 | Puchala et al. | 404/90 X |
| 4,911,188 | 3/1990 | Seidel | 239/750 X |

FOREIGN PATENT DOCUMENTS

| | | | |
|---|---|---|---|
| 2027776 | 2/1980 | United Kingdom . | |
| 1602177 | 11/1981 | United Kingdom | 239/750 |

OTHER PUBLICATIONS

Drawings (2 FIGS.).
Product description "Upgrading Kit Conjet".
Copy of letter dated Apr. 25, 1988 to Alan Weiner, from Christer Nohle.
Letter to Jacobacci, Casetta & Perani dated Jun. 29, 1990.
Drawings (FIGS. 8 & 8*b*).
Copy of Invoice dated Mar. 13, 1989.
Copy of Invoice dated Aug. 1988.
Copy of Letter dated Apr. 19, 1993.

*Primary Examiner*—Andres Kashnikow
*Assistant Examiner*—William Grant
*Attorney, Agent, or Firm*—McAulay Fisher Nissen Goldberg & Kiel

[57] ABSTRACT

A device for processing a concrete layer by water jets, comprising a jet tube on a carriage moveable to and fro along a guide. The jet tube is pivoted in planes substantially parallel to the guide and oscillates in planes making an angle with the guide. The jet tube is inclined in one direction along the extension of the guide during the movement of the carriage along the guide, and a control unit ensures that pivoting of the jet tube with an angular velocity leading to movement of a nozzle of the jet tube along the guide with a velocity substantially equal to the velocity of the carriage is initiated at the same time as the carriage is stopped in an end position, and the control unit starts the movement of the carriage in an opposite direction when the jet tube has finished its pivoting movement.

20 Claims, 4 Drawing Sheets

DEVICE FOR MATERIAL REMOVING PROCESSING OF A MATERIAL LAYER

This is a continuation of application Ser. No.: 08/030,017 filed on Mar. 22, 1993, abandoned.

FIELD OF THE INVENTION AND PRIOR ART

The present invention relates to a device for material removing processing of a material layer. Although the layer may consist of another material, concrete layers are preferably intended here. The processing is intended to primarily have the purpose to remove weakened material from the layer. It may be the question of removing weakened concrete from concrete layers of walls, bridges and all kinds of other building constructions, whereupon the concrete removed may be replaced by a new one. The high pressure fluid is preferably constituted by water.

Such devices are known per se. As examples of the prior art reference may be made to the Swedish patent publications 451 742 and 461 535. The prior art has the disadvantage that the control of the movements of the jet tube is defective, so that a more or less uneven processing result is obtained on the concrete layer. It should here be underlined that it is essential that defective material is really removed but on the other hand unnecessary material volumes should for economical reasons not be removed, since this raises the cost for the subsequent application of new material. The movements of the jet tube are according to the prior art controlled especially in the region of the end positions of the carriage but also for the rest so that the regularity mentioned above concerning the processing occurs.

SUMMARY OF THE INVENTION

The object of the present invention is to show constructive measures for developing a device so that an improved evenness is obtained as far as the material removing processing is concerned over the entire layer surface to be processed.

By means of the solution of the invention, an even processing effect is obtained in the region of the two end positions of the carriage owing to the fact that the jet tube is arranged to be brought into pivoting movement for returning substantially simultaneously as the carriage stops in its end position, wherein the carriage is arranged to be put into movement again, namely in the direction towards its second end position substantially simultaneously as the jet tube terminates its pivoting. The pivoting of the jet tube and the movement of the carriage are carried out with such velocities that the nozzle of the jet tube will move along the longitudinal direction of the guide during substantially the entire turning operation.

The development ensures the even processing effect on the material layer by an oscillating movement of the jet tube in such a way that the nozzle will move to and fro in a direction substantially transversal with respect to the guide while a carriage moves therealong.

Further preferred developments of the inventional idea are defined herein below.

BRIEF DESCRIPTION OF THE DRAWINGS

With reference to the appended drawings, below follows a specific description of an embodiment of the invention cited as an example.

In the drawings.

DETAILED DESCRIPTION OF A PREFERRED EMBODIMENT

Figure 1:
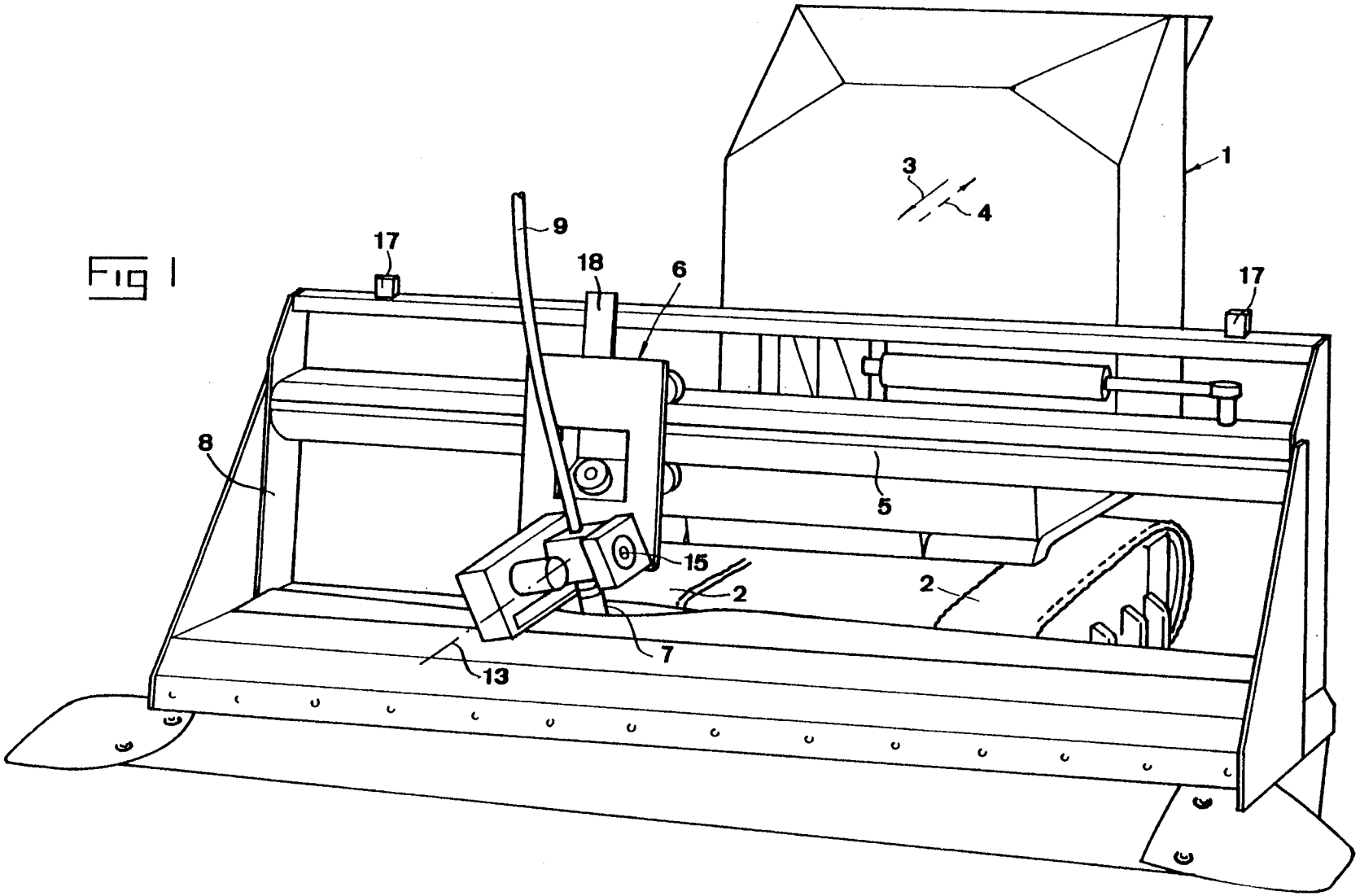
FIG. 1 is a schematic perspective view of the device according to the invention.

The device according to the invention comprises a carrier 1, which here has the character of a vehicle movable on the underlayer, for instance a layer of concrete, which is to be processed. The vehicle is here indicated as being of the track type with two driving tracks 2. The vehicle is as indicated by the arrows 3 and 4 movable in opposite directions.

On the vehicle 1 there are arranged a longitudinal guide 5 and a carriage 6 movable to and fro along this guide and carrying a jet tube 7 for directing a high pressure fluid jet towards the underlayer. The guide 5 is intended to in function extend while making an angle with the directions of movement 3, 4 of the vehicle and preferably substantially transversally thereto. The guide 5, which may have the character of a girder, is in the example substantially rectilinear. Furthermore, the guide 5 forms a part of a stand 8, which is mounted on the vehicle. The jet tube 7 communicates through a conduit 9 with a source for supplying a high pressure liquid, in particular water, to the jet tube. This high pressure source is suitably arranged on a separate carriage or the like, although it may also be arranged on the vehicle 1.

Figure 7:
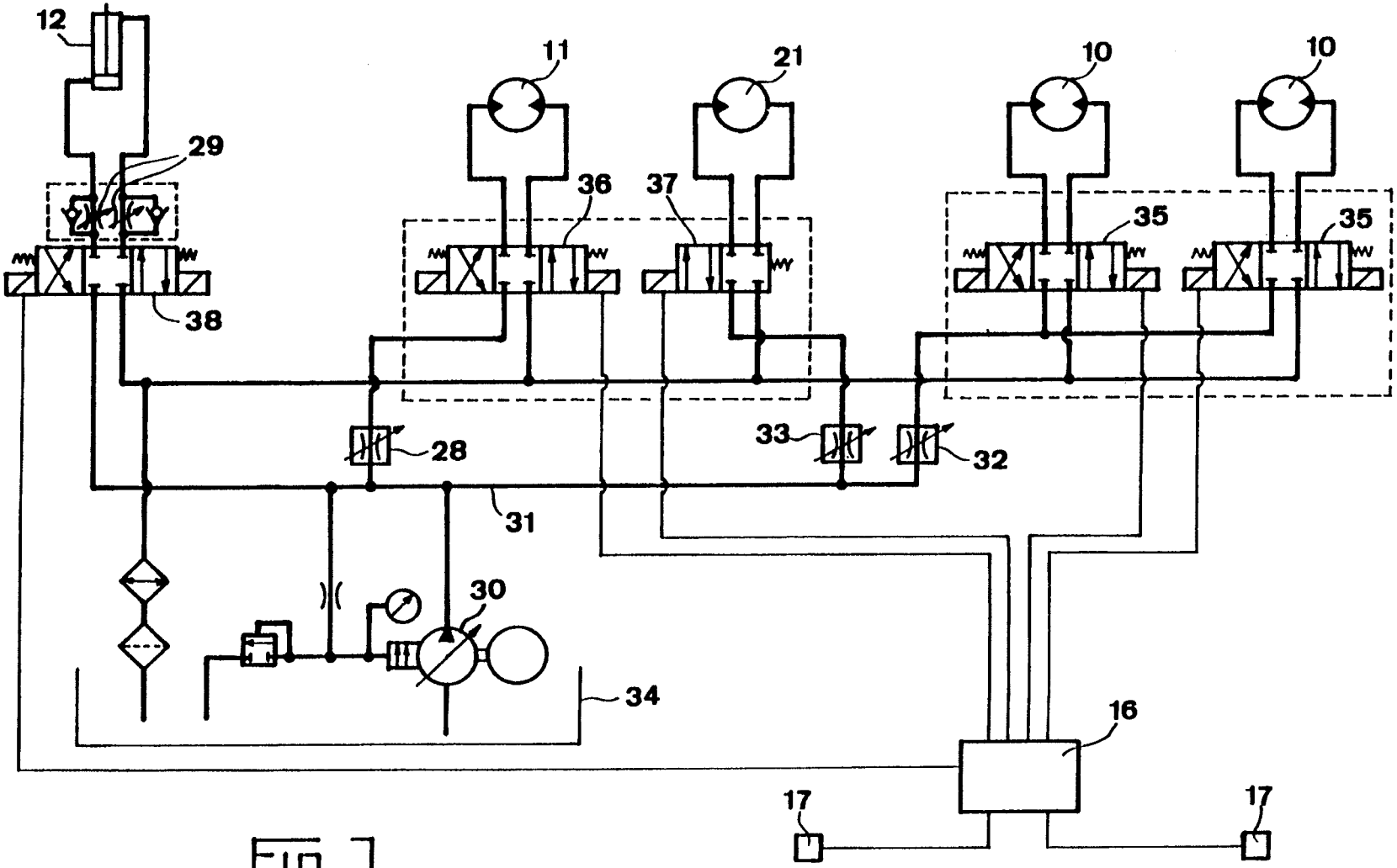
FIG. 7 is a circuit diagram.

As it will be described more in detail below by means of FIG. 7, the device comprises driving means 10 for driving the vehicle 1 in the directions 3, 4, a driving means 11 for driving the carriage 6 along the guide 5 and a driving means 12 for pivoting the jet tube 7 about an axis 13 extending substantially transversely to the guide 5 between extreme positions appearing from FIG. 4 and 5. A nozzle 14 of the jet tube is in these extreme positions directed while making an oblique angle with the longitudinal direction of the guide 5. The jet tube may be arranged to be directed obliquely either in or opposed to the direction of movement of the carriage 6 taking place for the moment. The choice of the inclination direction of the jet tube depends upon the processing result aimed at and the character of the material. The mode of operation in which the nozzle of the jet tube during the movement of the carriage 6 along the guide 5 is always directed in the direction of movement of the carriage independently of in which direction along the guide the carriage is presently moving will be discussed in the continuation of the description below.

It is suitable that the jet tube 7 is arranged to carry out an oscillating movement in the direction of movement 3, 4 of the carrier 1 about an axis 15. This oscillating movement is in other words intended to take place in planes being substantially parallel to the pivot axis 13 of the jet tube 7.

A control unit 16 (FIG. 7), for instance a suitable computer, arranged to control the driving means is arranged to, when the carriage 6 has reached an end position along the guide 5, control the driving means 12 to pivot the jet tube 7 so that the nozzle thereof during the movement of the carriage in its two directions of movement will be directed in the direction of movement thereof. The end positions of the carriage 6 are defined by detecting means 17, which are connected to the control unit 16. As indicated in FIG. 1, a one-armed member 18 is secured on the carriage 6 and intended to cooperate with the detecting means 17.

An attachment 19 for the jet tube 7 is oscillatingly arranged about the axis 15 on a holder 20, which in its turn is turnably arranged on the carriage 6 about the axis 13. This means that the jet tube 7 will pivot about the axis 13 upon turning the holder 20 thereabout.

Figure 2:
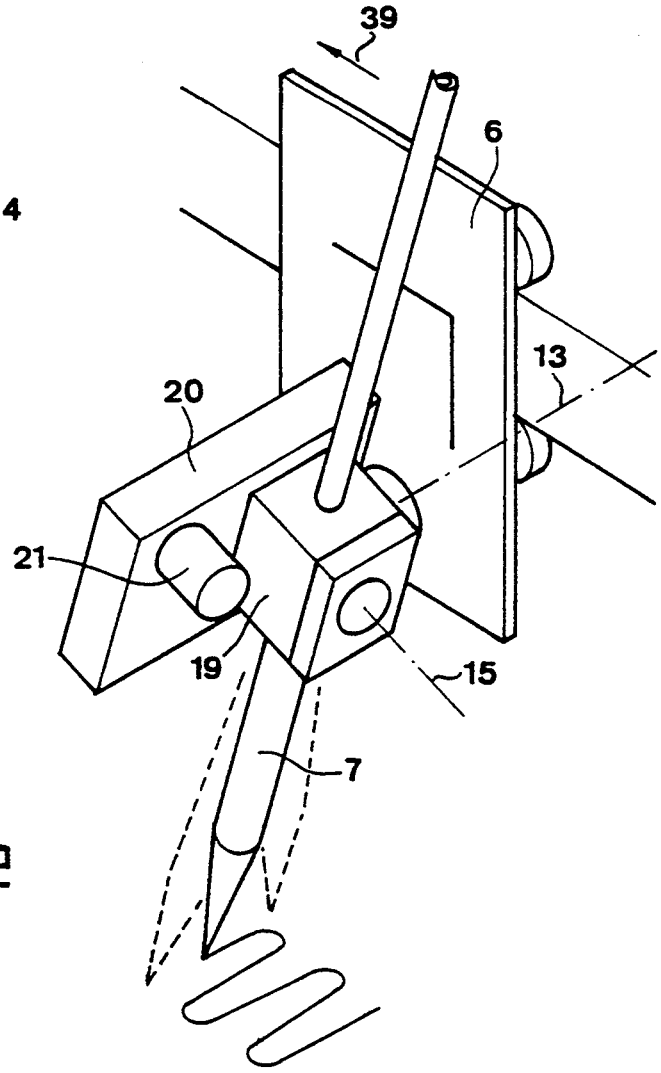
Figure 6:
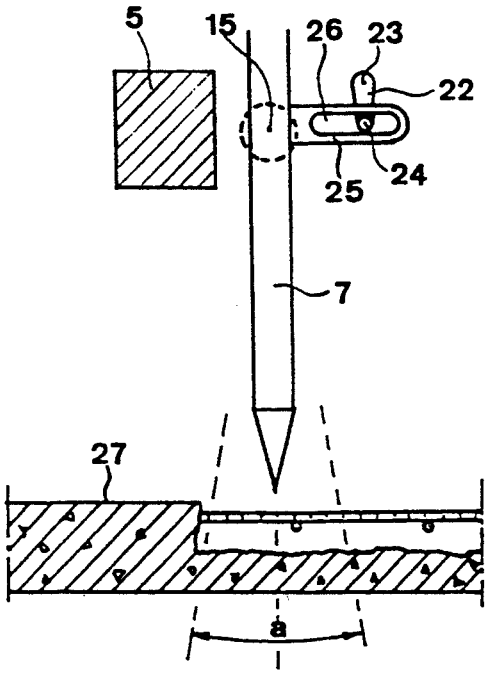
FIG. 6 is a schematic view of the jet tube seen substantially parallel to the guide, wherein an oscillating mechanism for the jet tube is indicated.

Driving means for making the jet tube 7 pivot about the axis 15 comprise (FIG. 2 and 6) a motor 21 and an eccentric 22 driven by means of the motor. This is intended to rotate about an axis 23 and has an extension 24 being eccentrical with respect to this axis and acting upon the attachment 19. A lever 25 having a slit 26 engaged by the extension 24 is rigidly attached to the attachment 19. Thus, the jet tube 7 will upon rotation of the eccentric 22 be put into an oscillating movement indicated by the circular arc a in planes making an angle, preferably a substantially right angle, with the longitudinal direction of the guide 5. It is preferred that the oscillating angle a is less than 30° but on the other hand at least 5° and preferably at least 10°. The jet tube 7 extends in the middle of this oscillating movement, as seen in the longitudinal direction of the guide 5, substantially in the direction normal to the layer 27 to be processed.

The motor 21 is arranged on the holder 20 and the eccentric 22 is also mounted on the holder 20 in a bearing. It is preferred that the axis of rotation 23 of the eccentric 22 is adjustably arranged on the holder 20, so that the distance of the axis 23 to the oscillating axis 15 may be varied. The oscillating angle a could by that also be varied.

It is preferred that the driving means 12 for pivoting the holder 20 about the axis 13 with respect to the carriage 6 is constructed as a power means varying its length acting between a point on the carriage 6 and a point on the holder 20 being eccentrical with respect to the axis 13. This power means is suitably a double-acting fluid piston cylinder mechanism (FIG. 7).

Although other embodiments are well possible, the driving means 11 for the movement of the carriage 6 along the guide 5 may have the character of a motor, for instance a hydraulic motor, which is arranged on the carriage 6 and drives at least a wheel or gear, which is rotary arranged on the carriage and in a driving engagement with the guide 5.

The control unit 16 (FIG. 7) is arranged or adjustable to control the cylinder 12 substantially simultaneously as the carriage 6 is stopped in the first end position defined by one of the detecting means 17 initiate pivoting of the jet tube about the axis 13 with an angular velocity which leads to a velocity of the nozzle 14 along the guide 5 being substantially equal to the velocity of the carriage 6 along the guide, said control unit being arranged or adjustable to control the driving motor 11 of the carriage 6 to initiate the movement of the carriage towards the second end position substantially simultaneously as the pivoting of the jet tube 7 by means of the cylinder 12 is terminated. The jet tube 7 will in other words with its nozzle 14 be in a substantially continuous movement with the same speed along the guide 5 during the entire turning sequence in the end positions of the carriage.

The device comprises means 28 and 29 for adjusting the velocity of the carriage 6 and the pivoting velocity of the jet tube 7, respectively. In the embodiment driven by means of compressed fluid, in particular hydraulic fluid, shown in FIG. 7, these adjusting means 28, 29 are considered to be constituted by flow regulating valves in fluid conduits belonging to the motor 11 and the cylinder 12, respectively. The compressed fluid system according to FIG. 7 comprises in a way known per se a pump 30, which through compressed fluid conduits 31 delivers compressed fluid not only to the driving means 11 and 12 but also to the driving means 10 and 21. There are also valves 32 and 33 in the compressed fluid supplying conduits to the driving means 10 and 21, respectively, which by flow regulation enable adjustment of the operating speeds of the driving means 10, 21 constructed as compressed fluid motors. Return conduits for compressed fluid from the driving means 10, 11, 12 and 21 may in conventional manner emerge into a compressed fluid tank 34, from which the pump 30 is supplied with fluid.

There are control means 35-38 for each of the driving means 10, 11, 12 and 21 with the task to start, stop and (concerning all driving means except for 21 for the oscillating movement) reverse the direction of the function of the driving means. These control means 35-38 are in the compressed fluid case illustrated fluid valves, which by schematically indicated connections to the control unit 16 are subjected to control by the latter. The speed regulating valves 32, 33 and 28 for the driving means 10, 21 and 11, respectively, may suitably be arranged in the supply conduits to the latters. With respect to the driving means designed as a cylinder 12 for the pivoting of the jet tube 7 about the axis 13 it is however suitable to arrange, in each of the conduits extending between a control valve 38 and the two working chambers of the cylinder 12, the earlier mentioned valve 29 regulating flow and thereby regulating the speed of length variation of the cylinder 12 and a non-return valve opening to the respective working chamber of the cylinder 12 parallel to each other, which means that the flow regulation and thereby the speed regulation will take place in the one of the conduits between the control valve 38 and the cylinder 12 for the moment functioning as a return conduit.

The control unit 16 comprises a suitably adjustable time delaying means for delaying the initiation of the movement of the carriage, when the carriage has reached a first end position, towards the second end position with a period of time corresponding to the time required for the pivoting of the jet tube by means of the driving means 12 from its one extreme position to the other.

It appears from above that the control unit 16 is intended to contain a control program, in which the operator may choose the time delay of the time delaying means to be equal to the time required for the pivoting of the jet tube and also equal to the time during which the carriage 6 does not move on reaching an end position.

The control unit 16 is arranged to control the driving means 10 through the control means/valves 35 to move a distance set when the carriage 6 reaches one of its end positions. The velocity of this movement is determined by the control means/valve 32. The control unit 16 contains a clock adjustable by the operator for defining the movement distance aimed at, so that this clock determines the period of time during which the driving means 10 are in function and thereby the distance. Since the driving means 10 have a control means 35 each, the operator may if required adjust the direction of the vehicle 1 by instantaneously only set one of the driving means 10 into function.

Figure 4:
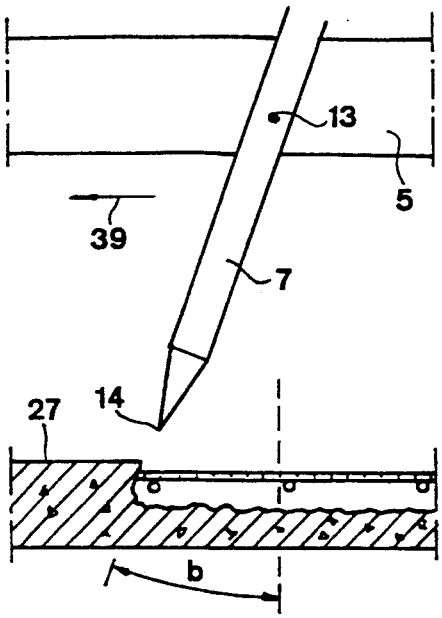
FIG. 4 and 5 are schematic views of the jet tube, which is illustrated in its two extreme positions and seen perpendicularly to the guide.
Figure 5:
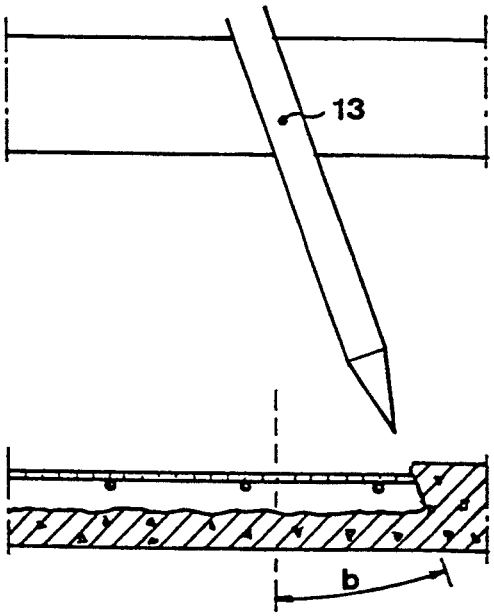

It appears from FIG. 4 and 5 that the jet tube 7, as seen parallely to the pivot axis 13 thereof, is able to pivot through angles b in opposite directions from a central position, in which a jet tube is directed as a normal to the surface to be processed. The angle b is preferably maximally 30°, which means that the pivoting movement of the jet tube totally comprises maximally 60°.

The device described functions in the following way: The operator determines in dependence on the actual operating conditions by means of the adjustment means 32 the velocity of the movement of the vehicle 1. The resulting transport distance may be determined by setting the time for the duration of this movement in the control unit 16. The operator determines by means of the adjustment means 33 the oscillating speed of the jet tube 7. Furthermore, the operator determines by means of the adjustment means 28 the velocity of the carriage 6. The operator determines after that by means of the adjustment means 29 the angular velocity for the pivoting movement of the jet tube so that the nozzle 14 will move with substantially the same speed along the guide 5 as the velocity of the carriage 6. The operator adjusts after that the time delaying means mentioned, so that the movement of the carriage 6 along the guide 5 is not started until substantially simultaneously as the pivoting of the jet tube 7 about the axis 13 is terminated.

Figure 3:
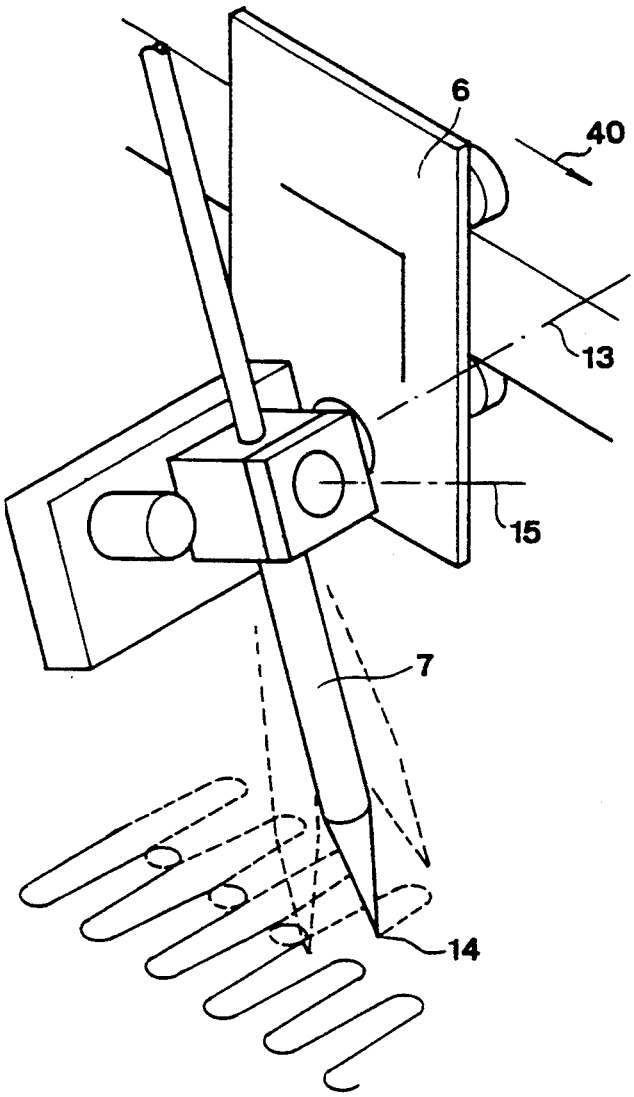
FIG. 2 and 3 are schematic perspective views illustrating the carriage carrying the jet tube of the device, wherein the movement pattern of the jet tube is also illustrated.

The following function is obtained after these adjustments: When the carriage 6 moves in the direction towards one of the end positions according to the arrow 39 in FIGS. 2 and 4, the jet tube 7 will oscillate about the axis 15 while the jet tube does not move with respect to the axis 13, so that the nozzle of the jet tube will in an inclining position be directed in the direction of movement 39 of the carriage. The nozzle 14 will thereby scan the surface of the underlayer to be processed in the way indicated in FIG. 2. When the carriage 6 reaches one of its end positions it is stopped by the control unit 16, which simultaneously by means of the control means 35 cause a movement of the vehicle 1 over the distance set and by means of the control means 38 starting of the pivoting of the jet tube 7 about the axis 13 in order to turn the jet tube between the positions in FIGS. 2 and 3. The carriage 6 is standing still during the entire pivoting of the jet tube 7 and the control unit 16 starts the carriage 6 for movement towards the second end position (arrow 40 in FIG. 3) not before substantially simultaneously as the jet tube finishes its turning. This means that every movement of the nozzle 14 in the direction of one of the arrows 39 and 40 will be composed by on one hand the pivoting movement of the jet tube 7 and on the other a displacement movement of the carriage 6. The moving path described by the nozzle 14 during the movement in the direction of the arrow 39 is schematically indicated in FIG. 3 by a continuous line, while the movement path described by the nozzle 14 on the movement in the direction of the arrow 40 is illustrated by dashed lines.

The oscillation of the jet tube 7 about the axis 15 in combination with the oblique direction of the jet tube towards the surface to be treated about the axis 13 lead to an eminent function also in difficult tasks, such as removing concrete around the enforcement bars located in the concrete layer. It would of course be possible in troublesome conditions to adjust the control unit 16 so that the vehicle 1 is not moved to a greater extent than that through which the jet tube 7 scans the same surface at least twice with the jet tube in differently adjusted positions about the axis 13.

It is evident that the invention is not restricted to the embodiment described. The carrier 1 must for instance not necessarily be a vehicle but could instead have the character of a carriage movable along a stand arranged in a suitable way. Furthermore, the device is not at all restricted to processing of horizontal surfaces, but it may also be orientated for processing of vertical or inclined surfaces. The guide 5 must not necessarily be rectilinear, but it could for instance be curved in correspondence with the curving of a surface to be processed. The guide 5 could for the rest be adjustable into acute angles with respect to the normal direction of movement of the carrier 1 if this is required by the conditions. It has been described above how starting of the carriage 6 after a stop in an end position is delayed by means of a time delaying means until the jet tube 7 has finished its pivoting in order to turn. As an alternative thereto it would be possible to arrange a further detecting means reacting when the jet tube reaches its extreme pivot positions and then delivering information to the control unit 16, which in response to such information immediately starts the movement of the carriage 6. Other control principals could also be used here. Finally, it should be mentioned that it will be suitable for different tasks that the jet tube 7 is so directed that its nozzle 14 points in the direction of a normal to the surface to be processed, as seen parallely to the axis 13. The control unit 16 is accordingly arranged to enable setting of such a position of the jet tube. However, also such a position requires for good processing function oscillating of the jet tube about the axis 15. Other modifications are also possible within the scope of the inventional idea.

I claim:

1. A device for material removing processing of a material layer, in particular a concrete layer, said device comprising a carrier (1), a guide (5) arranged on the carrier, a carriage (6) movable to and fro along the guide and carrying a jet tube (7) for directing a high pressure fluid jet towards the material layer, a source for supplying high pressure fluid to the jet tube, at least one first driving means (10) for driving the carrier in a direction making an angle with the guide, at least one second driving means (11) for driving the carriage along the guide, at least one third driving means (12) for pivoting the jet tube about an axis (13) making an angle with the longitudinal direction of the guide between extreme positions in which a nozzle (14) on the jet tube is directed obliquely either in, or opposed to, the direction of movement of the carriage (6), and a control unit (16) arranged to control each of the driving means and, when the carriage has reached an end position along the guide, to control the at least one third driving means (12) to pivot the jet tube (7) selectively between first and second extreme positions, such that the nozzle thereof is directed with substantially the same angle of inclination with respect to the longitudinal direction of the guide when the carriage moves in each of its two directions of movement along the guide, characterized in that the control unit (16) includes means for controlling the at least one third driving means (12) substantially simultaneously as the carriage (6) is stopped in a first end position to initiate pivoting of the jet tube (7) with an angular velocity leading to a velocity of the nozzle (14) along the guide (5) being substantially equal to the velocity of the carriage along the guide, said control unit (16) further including means for controlling the at least one second driving means to initiate carriage movement towards a second end position substantially simultaneously as the pivoting of the jet tube to one of said extreme positions by said at least one third driving means is terminated.

2. A device according to claim 1, further including fourth driving means for oscillating the jet tube, such that the jet tube (7) is arranged to carry out an oscillating movement in planes being substantially parallel to the pivot axis (13) of the jet tube.

3. A device according to claim 2, characterized in that the control unit (16) is arranged to control said fourth driving means (21) to make the jet tube oscillate when the jet tube pivots as well as the carriage moves.

4. A device according to claim 3, characterized in that an attachment (19) for the jet tube (7) is oscillatingly arranged on a holder (20), said holder being pivotally arranged on the carriage (6).

5. A device according to claim 4, characterized in that the fourth driving means are arranged on the holder (20) and comprise a motor (21) and an eccentric (22) driven by the motor and acting upon the attachment.

6. The device according to claim 2, including a holder and an attachment for said jet tube oscillatingly arranged on said holder, said holder being pivotally arranged on said carriage.

7. The device according to claim 2, wherein said control unit includes adjustable time delay means for delaying the movement initiation of said carriage towards said second end position by a period of time needed for the pivoting of said jet tube, when said carriage reaches said first end position.

8. A device according to claim 1, characterized in that it comprises means (28, 29) for adjusting the velocity of the carriage (6) along the guide and the pivoting angular velocity of the jet tube (7).

9. The device according to claim 8, further including fourth driving means for oscillating the jet tube, such that said jet tube is arranged to carry out an oscillating movement in planes substantially parallel to the pivot axis of said jet tube.

10. The device according to claim 9, further comprising said control unit being arranged to control said fourth driving means for causing said jet tube to oscillate when said jet tube pivots and said carriage moves.

11. The device according to claim 8, wherein said control unit includes adjustable time delay means for, when said carriage has reached the first end position, delaying the movement initiation of said carriage towards the second end position by a period of time needed for the pivoting of said jet tube.

12. The device according to claim 8, wherein said first and second end positions of said carriage are defined by detecting means connected to said control unit, and said control unit is responsive to information from said detecting means for controlling the pivoting of said jet tube.

13. A device according to claim 1, characterized in that the control unit (16) contains a suitably adjustable time delay means for, when the carriage has reached said first end position, delaying the movement initiation of the carriage towards the second end position by a period of time needed for the pivoting of the jet tube between said first and second extreme positions.

14. A device according to claim 1, characterized in that the first and second end positions of the carriage are defined by detecting means (17) connected to the control unit (16), and that the control unit is arranged to control the pivoting of the jet tube on the basis of information from the detecting means.

15. A device for material removing processing of a material layer comprising:

a carrier, a guide arranged on said carrier, and a carriage movable to and fro along said guide;

a jet tube, including a nozzle, carried by said carrier, and a source for supplying high pressure fluid to said jet tube for directing a high pressure fluid jet towards the material layer;

first driving means for driving said carrier in a direction angled with respect to the longitudinal direction of said guide, second driving means for driving said carriage along the longitudinal direction of said guide, and third driving means for pivoting said jet tube about an axis making an angle with the longitudinal direction of said guide between extreme positions in which said nozzle on said jet tube is directed obliquely either in, or opposed to, the direction of movement of said carriage (6); and a control unit for controlling said second driving means and, when said carriage has reached an end position along said guide, for controlling said third driving means for pivoting said jet tube selectively between first and second extreme positions, such that said nozzle is directed with substantially the same angle of inclination with respect to the longitudinal direction of the guide when the carriage moves in each of its two directions of movement along the guide;

said control unit controlling said third driving means substantially simultaneously as said carriage is stopped in a first end position to initiate pivoting of said jet tube with an angular velocity leading to a velocity of said nozzle along said guide being substantially equal to the velocity of said carriage along said guide, and said control unit also controlling said second driving means to initiate carriage movement towards a second end position substantially simultaneously as the pivoting of said jet tube to one of said extreme positions by said third driving means is terminated.

16. The device according to claim 15, including means for oscillating said jet tube about an axis different from said pivot axis for said jet tube.

17. The device according to claim 15, including detecting means connected to said control unit for defining the first and second end positions of said carriage, said detecting means and said control unit controlling the pivoting of said jet tube on the basis of information from said detecting means.

18. The device according to claim 15, wherein said control unit includes an adjustable time delay means for delaying the movement initiation of said carriage towards one of said first and second end positions by a period of time needed for the pivoting of said jet tube between one of said first and second extreme positions to the other of said first and second extreme positions, when said carriage has reached the other of said first and second end positions.

19. The device according to claim 15, including a fourth driving means for oscillating said jet tube while said jet tube pivots and said carriage moves.

20. The device according to claim 15, including means for oscillating said jet tube in planes substantially parallel to the pivot axis of said jet tube.

* * * * *